US007871511B2

(12) United States Patent
Varadaraj et al.

(10) Patent No.: US 7,871,511 B2
(45) Date of Patent: Jan. 18, 2011

(54) METHOD TO ALTER COKE MORPHOLOGY USING EITHER POLYNUCLEAR AROMATIC COMPOUNDS OR FUNCTIONALIZED LIGNIN

(75) Inventors: Ramesh Varadaraj, Flemington, NJ (US); Michael Siskin, Randolph, NJ (US); Leo D. Brown, Baton Rouge, LA (US)

(73) Assignee: ExxonMobil Research & Engineering Co., Annandale, NJ (US)

( * ) Notice: Subject to any disclaimer, the term of this patent is extended or adjusted under 35 U.S.C. 154(b) by 31 days.

(21) Appl. No.: 12/213,758

(22) Filed: Jun. 24, 2008

(65) Prior Publication Data

US 2009/0314689 A1 Dec. 24, 2009

(51) Int. Cl.
*C10G 9/14* (2006.01)

(52) U.S. Cl. ..... 208/131; 208/48 AA; 208/208 R

(58) Field of Classification Search ..... 208/48 AA, 208/48 R, 131
See application file for complete search history.

(56) References Cited

U.S. PATENT DOCUMENTS

| | | | | |
|---|---|---|---|---|
| 6,204,421 | B1 * | 3/2001 | Genssler et al. | 585/240 |
| 2005/0258070 | A1 | 11/2005 | Varadaraj et al. | |
| 2005/0279672 | A1 * | 12/2005 | Varadaraj et al. | 208/131 |
| 2006/0060506 | A1 | 3/2006 | Siskin et al. | |
| 2009/0184029 | A1 | 7/2009 | Varadaraj et al. | |

* cited by examiner

*Primary Examiner*—Robert J Hill, Jr.
*Assistant Examiner*—Brian McCaig
(74) *Attorney, Agent, or Firm*—Glenn T. Barrett; Malcolm D. Keen

(57) ABSTRACT

A method for altering coke morphology in a delayed coking process of heavy oil is provided. An effective amount of one or more oil dispersible or oil soluble polynuclear aromatic compounds, or functionalized lignin, is added or contacted with the resid or heavy oil at a point before or after the step of heating the heavy oil to coking temperatures. The addition of additives facilitates the formation of shot coke and inhibits the formation of sponge coke.

17 Claims, 4 Drawing Sheets

METHOD TO ALTER COKE MORPHOLOGY USING EITHER POLYNUCLEAR AROMATIC COMPOUNDS OR FUNCTIONALIZED LIGNIN

1.0 BACKGROUND OF THE INVENTION

1.1 Field of the Invention

The present invention relates to the use of either oil dispersible or oil soluble polynuclear aromatic compounds or functionalized lignin as additives to delayed coking feeds.

1.2 Description of Related Art

Delayed coking is a process for the thermal conversion of heavy oils such as petroleum residua (also referred to as "resid") to produce liquid and vapor hydrocarbon products and coke. Delayed coking of resids from heavy and heavy sour (high sulfur) crude oils is carried out to convert part of the resids to more valuable hydrocarbon products. The resulting coke has value, depending on its grade, as a fuel (fuel grade coke), electrodes for aluminum manufacture (anode grade coke), etc.

In the delayed coking process, the feed is rapidly heated at about 500° C. (932° F.) in a fired heater or tubular furnace. The heated feed is conducted to a coking vessel (also called a "drum") that is maintained at conditions under which coking occurs, generally at temperatures above about 380° C. (716° F.) and super-atmospheric pressures. Coke drums are generally large, upright, cylindrical, metal vessels, typically ninety to one-hundred feet in height, and twenty to thirty feet in diameter. Coke drums have a top portion fitted with a top head and a bottom portion fitted with a bottom head. Coke drums are usually present in pairs so that they can be operated alternately. Coke accumulates in a vessel until it is filled, at which time the heated feed is switched to the alternate empty coke drum. While one coke drum is being filled with heated residual oil, the other vessel is being cooled and purged of coke.

Typically in the cooling step, the filled drum is quenched with water to lower the temperature to a range of about 93° C. to about 148° C. (about 200° F. to about 300° F.), after which the water is drained. When the cooling step is complete, the drum is opened and the coke is removed by drilling and/or cutting. The coke removal step is frequently referred to as "decoking."

In delayed coking, the coke is typically cut from the drum using a high speed, high impact water jet. A hole is typically bored in the coke from water jet nozzles located on a boring tool. Nozzles oriented horizontally on the head of a cutting tool cut the coke from the drum. The coke removal step adds considerably to the throughput time of the process. Drilling and removing coke from the drum takes approximately 1 to 6 hours, and the coker drum is not available for feed coking until the coke removal step is completed. This delay can unfavorably impact the yield of hydrocarbon vapor from the process. Thus, it would be desirable to be able to produce a free-flowing coke in a coker drum, which could be removed more speedily, thereby minimizing the expense and cycle time associated with conventional coke removal.

An additional difficulty that may arise in decoking results from non-uniform coke cooling prior to decoking, a problem sometimes called a "hot drum." Hot drums occur when, following water quench, regions of the coke volume in the drum remain at a significantly higher temperature than other regions. Hot drum may result during cutting or drilling from the presence of different coke morphologies (e.g., shot and needle or shot and sponge) in different regions of the drum. As a result of the different thermal characteristics among the coke morphologies, some coke regions in the drum may differ in temperature significantly from other regions, which can lead to unpredictable and even hazardous conditions during decoking. Since free-flowing coke morphologies cool faster than agglomerated coke morphologies, it would also be desirable to produce predominantly free-flowing coke in a delayed coker in order to avoid or minimize hot drums.

2.0 BRIEF DESCRIPTION OF THE DRAWINGS

The following figures are for illustrative purposes only and are not intended to limit the scope of the present invention in any way:

3.0 SUMMARY OF THE INVENTION

Figure 1:
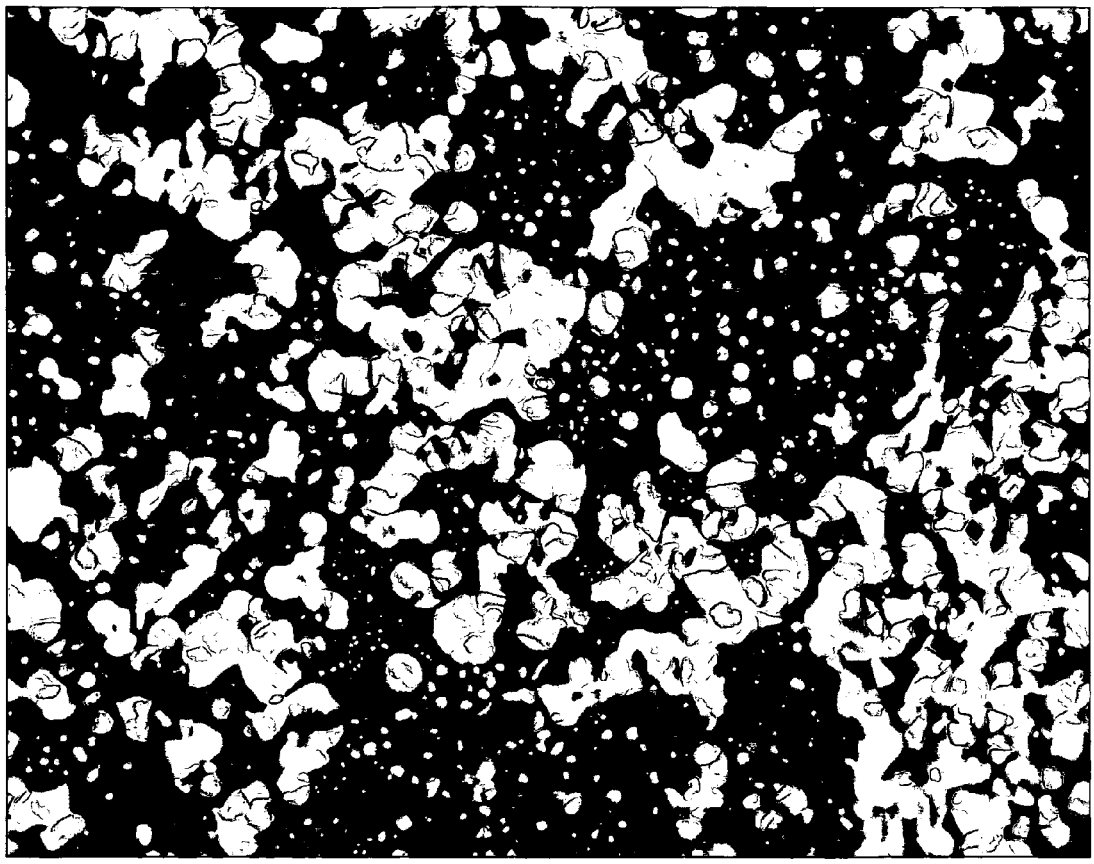
FIG. 1 is an optical micrograph, with a viewing area of 174 microns by 130 microns, showing a comparative/control example of coke formed from a sponge coke-forming resid feed that contains no additive.

A method for altering the coke morphology in a delayed coking process of heavy oil, such as a resid, is provided. In a first embodiment, the method has the following steps:

a) contacting the heavy oil with an oil soluble or oil dispersible additive to provide an additized heavy oil, which additive is comprised of one or more polynuclear (or alternatively referred to as "polycyclic") aromatic compounds; and b) thermally treating said additized heavy oil at a coking temperature in a coking zone. (e.g., coke drum).

Alternatively, in a second embodiment, the method has following steps:

a) contacting the heavy oil with a functionalized lignin; and b) thermally treating said additized heavy oil at a coking temperature in a coking zone. (e.g., coke drum).

Polynuclear aromatic compounds of the following structure are particularly preferred:

$$(PNA)\text{-}R_y$$

where "PNA" in the formula represents a polynuclear aromatic compound of from 2 to 15 aromatic rings that are fused together and/or linked through carbon-carbon bonds, where "R" is selected from hydrogen, an alkyl group containing 1 to 20 carbon atoms that is directly attached to an aromatic ring or indirectly attached to an aromatic ring through an oxygen, nitrogen or sulfur containing functional group, and where y is an integer from 1 to 50. A fused ring aromatic PNA is preferred. In a more preferred embodiment the PNA is comprised of from 2 to 10 aromatic rings. In yet another preferred embodiment the PNA contains from 2 to 8 aromatic rings. In still another preferred embodiment the PNA is selected from the group consisting of 1-methyl naphthalene, 2-methyl naphthalene, 2-ethyl naphthalene, isoquinoline, triphenylene, HOT, HAT-6, HAT 8, pyrene and perylene.

The additive is added in an amount effective to increase the formation of substantially free flowing coke during thermal coking operations. The preferred coke morphology (i.e., a typical morphology that is indicative of a substantially free-flowing shot coke) has a coke microstructure of discrete micro-domains having an average size ranging from about 0.5 to 10 μm, preferably from about 1 to 5 μm. It is believed that the additive suppresses the mesophase formed by hydrocarbon compounds present in the heavy oil.

4.0 DETAILED DESCRIPTION

4.1 Overview

According to one embodiment of the invention, there is provided a method for altering the coke morphology produced in delayed coking processes of heavy oil. Non-limiting examples of heavy oils include crude oil, vacuum resid, atmospheric resids, tar sands bitumen, coal liquids, shale oils and their heavy fractions. An effective amount of either an oil dispersible or oil soluble polynuclear aromatic compounds or a functionalized lignin is added or contacted with the heavy oil feed at a point before or during the step of thermally treating the feed at coking temperatures (i.e., at operating temperatures ranging from about 380° C. to about 500° C. in the coking zone). The addition of the polynuclear aromatic compounds or functionalized lignin (collectively referred to herein as "additive") enhances or facilitates the formation of shot coke and inhibits the formation of sponge coke.

The additive can be added at one or more points in the coking process. The additive may be added before preheating or after preheating. The additive may be added, for example, while the preheated feed is being conducted to the coker drum and/or while the preheated feed is injected into the coking zone and/or during heating to the coking temperature. The same additive or additives can be added independently at each location or a different additive or additives can be added at each location.

4.2 Additives

The preferred oil soluble or oil dispersible additives are polynuclear aromatic compounds. The polynuclear aromatic compounds can have alkyl substituents to increase oil solubility. The polynuclear or polycyclic aromatic compounds contain 2 to 15 aromatic rings, preferably about 2 to 10 aromatic rings, and more preferably from about 2 to 8 aromatic rings. The aromatic rings can be fused or isolated aromatic rings. Further, the aromatic rings can be homonuclear or heteronuclear (heterocyclic) aromatic rings. As used herein, homonuclear aromatic rings means aromatic rings containing only carbon and hydrogen; heteronuclear (heterocyclic) aromatic ring means aromatic rings that contain nitrogen, oxygen, sulfur or a mixture thereof, in addition to carbon and hydrogen.

Non-limiting examples of oil soluble polynuclear aromatic compounds of the present invention are shown below.

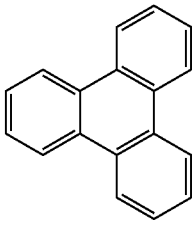

Triphenylene

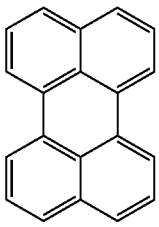

Perylene

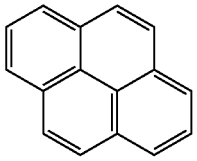

Pyrene

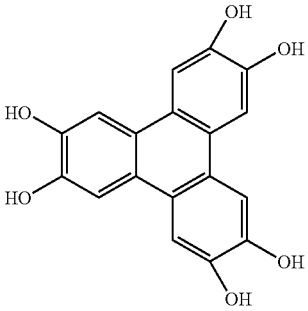

HOT

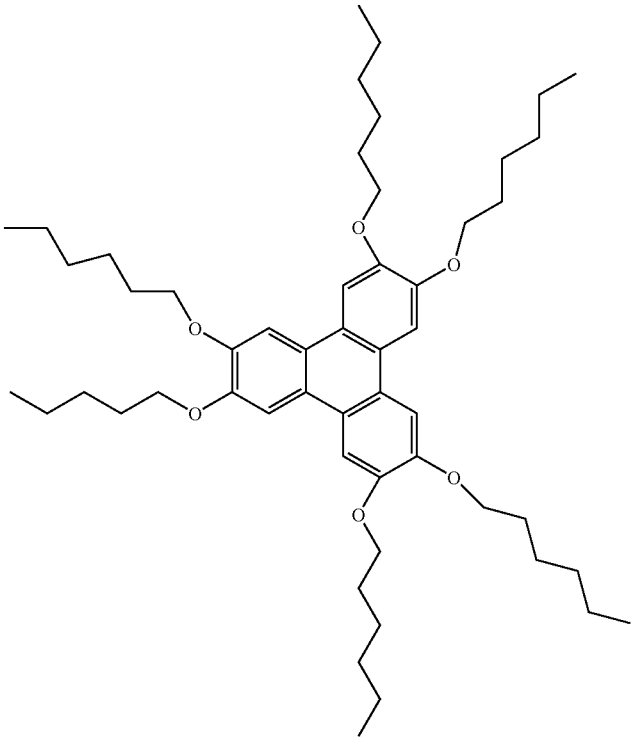

HAT-6

-continued

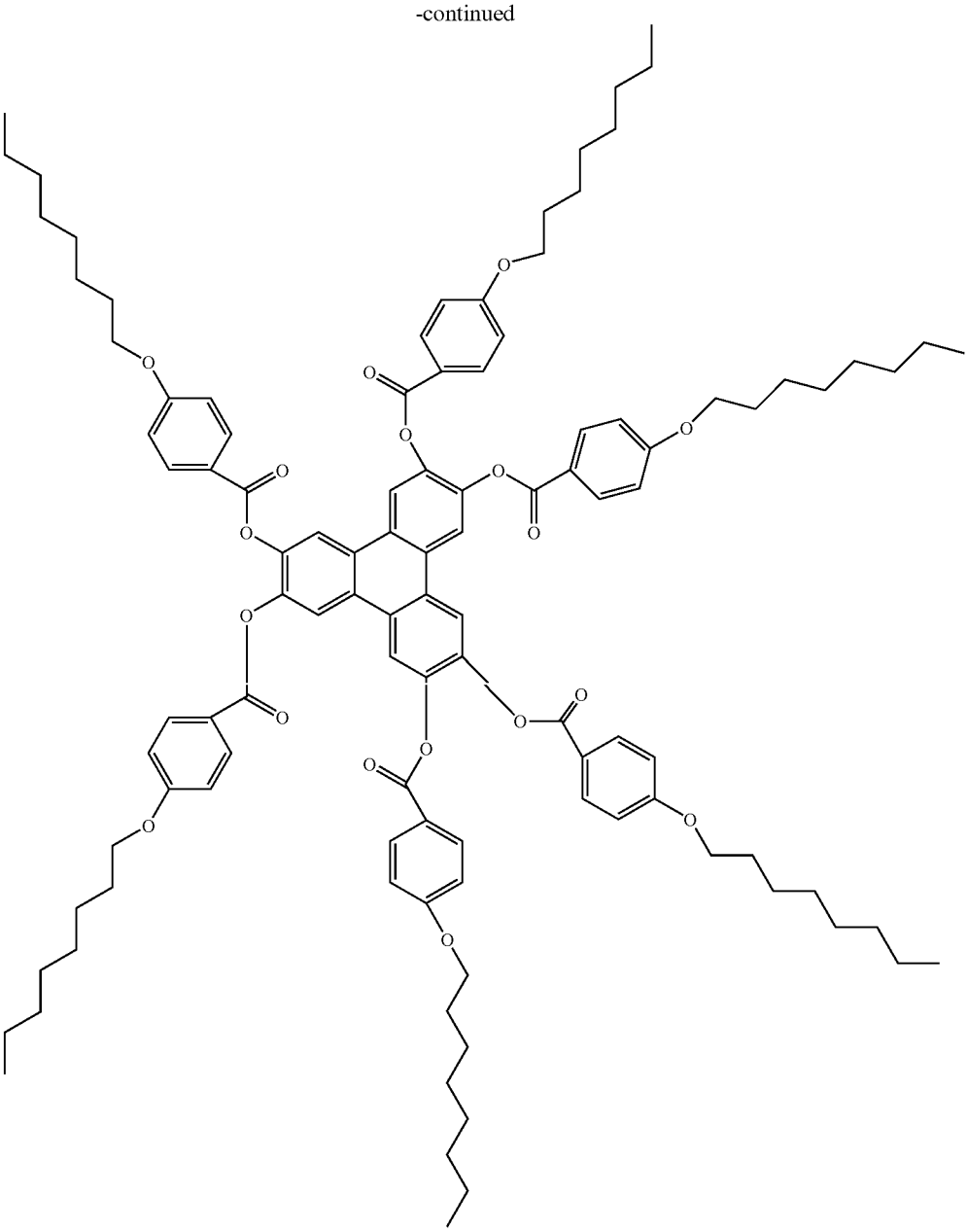

HAT-8

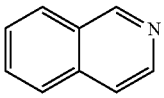

Isoquinoline

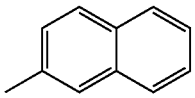

2-methyl naphthalene

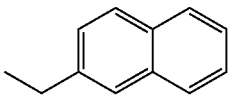

2-ethyl napthalene

Heavy aromatic fuel oil (HAFO) and catalytic slurry oil (CSO) are polynuclear aromatic rich refinery streams that are also suitable additives.

Applicants have also found that a functionalized lignin, e.g., a sulfonated lignin is an alternative additive. Lignin is readily available and can be sulfonated using known sulfonation agents such as sulfuric acid or sulfur trioxide. Once sulfonated, it can be converted to a salt. Preferred salts are salts of Group 1 and 2 of the Periodic Table of Elements and ammonium salts. Sodium, potassium and calcium salts are preferred. Mixtures of Na, K and Ca salts also preferred.

Typically, the amount of additive added can be about 10 to about 50,000 wppm, preferably about 20 to 3000 wppm, more preferably 20 to 1000 and more preferably from about 50 to about 600 wppm based on the amount of crude oil or crude oil residuum. The additive can be added as is or in a suitable carrier solvent. Preferred carrier solvents are aromatic hydrocarbon solvents such as toluene, xylene, crude oil derived aromatic distillates such as Aromatic 150 sold by ExxonMobil Chemical Company, water, alcohols and mixtures thereof.

4.3 Delayed Coking

Heavy oils such as resid feeds are typically subjected to delayed coking. Generally, in delayed coking, a residue fraction, such as a petroleum residuum feedstock is pumped to a heater at a pressure of about 50 to 550 psig (344.74 to 3792.12 kPa), where it is heated to a temperature from about 480° C. to about 520° C. (preferably greater than 500° C.). It is then discharged into a coking zone, typically a vertically-oriented, insulated coker drum through an inlet at the base of the drum. Pressure in the drum is usually relatively low, such as about 15 to 80 psig (103.42 to 551.58 kPa) to allow volatiles to be removed overhead. Typical operating temperatures of the drum will be between about 410° C. and 475° C. The hot feedstock thermally cracks over a period of time (i.e., the "coking time") in the coker drum, liberating volatiles composed primarily of hydrocarbon products that continuously rise through the coke mass (bed) and are collected overhead. The volatile products are sent to a coker fractionator for distillation and recovery of coker gases, naphtha, light gas oil and heavy gas oil fractions. In some instances, a small portion of the heavy coker gas oil present in the product stream introduced into the coker fractionator can be captured for recycle and combined with the fresh feed, thereby forming the coker heater or coker furnace charge. In addition to the volatile products, delayed coking also forms solid coke product.

4.4 Introduction of Additives into the Heavy Oil

Introducing or contacting the additive with the heavy oil can be achieved at any time before or after the pre-heating of the heavy oil, and preferably when the pre-heated heavy oil is conducted, discharged or otherwise transferred from the furnace or heater to the coking zone or coker vessel (alternatively referred to as a coker or coker drum). In particular, the additive can be added at one or more of the following points: prior to pre-heating the feed; after preheating but before the preheated feed is conducted to the coker drum; while the feed is being conducted to the coker drum and/or injected into the coker; and during coking (i.e., thermal treatment at a coking temperature). The same additives can be added independently at each location or a different additive or additives can be added at each location.

Use of the terms "add", "combine" and "contact" are meant in their broad sense. In some cases physical and/or chemical changes in the additive and/or the feed can occur in the additive, the feed, or both, when the additive is present in the feed. In other words, the invention is not restricted to cases where the additive and/or feed undergo no chemical and/or physical change following, or in the course of, the contacting and/or combining.

An "effective amount" of additive(s) is the amount of additive(s) that, when contacted with the feed, results in increased formation of free-flowing coke in the coking zone. An effective amount typically ranges from about 10 to about 5,000 ppm based on the total weight of the feed. Ideally, a substantially uniform free-flowing coke is formed throughout the coking zone. The preferred coke morphology (i.e., a typical morphology that is indicative of a substantially free-flowing shot coke) has a coke microstructure of discrete micro-domains having an average size of about 0.5 to 10 μm, preferably from about 1 to 5 μm.

Uniform dispersal of the additive into the resid feed is desirable to avoid heterogeneous areas of coke morphology formation. That is, it is preferred to avoid having locations in the coke drum where the coke is substantially free flowing and other areas where the coke is substantially non-free flowing. Uniform dispersal of the additive is one way to avoid heterogeneous areas of coke morphology formation and can be accomplished in any number of ways. Preferably, uniform dispersal is accomplished by introducing a side stream of the agent into the feed stream at the desired location.

In one embodiment, additives(s) are introduced to the heavy oil in a continuous mode. If needed, the additive(s) could be dissolved or slurried into an appropriate transfer fluid, which will typically be solvent that is compatible with the resid and in which the agent is substantially soluble. The fluid mixture or slurry is then pumped into the coking process at a rate to achieve the desired concentration of additive(s) in the feed. The introduction point of the additive(s) can be, for example, at the discharge of the furnace feed charge pumps or near the exit of the coker transfer line. There can be a pair of mixing vessels operated in a fashion such that there is continuous introduction of the additive(s) into the coking process.

4.5 Coke Products

There are generally three different types of solid delayed coker products that have different values, appearances and properties—namely, needle coke, sponge coke and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Shot coke is considered the lowest quality coke. The term "shot coke" comes from its shape, which is similar to that of BB-sized (about 1/16 inch to 3/8 inch) balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture.

The addition of the oil soluble polynuclear aromatic compounds or functionalized lignin to heavy oil aids the formation of a more free flowing coke and, more particularly, a free flowing shot coke. The formation of such free flowing coke reduces or minimizes the amount of drilling necessary to empty the drum and prepare it for the next cycle. More particularly, by aiding in the formation of free flowing shot coke, the amount of coke required to be cut from the drum, and the time required for cutting/polishing a drum can be markedly reduced because the bulk of the loose coke formed will be discharged from the drum without having to be cut. Ideally, the cutting step is completely eliminated. However, even if some cutting is still required to adequately clean the drum for the next cycle in some instances, cutting time is still reduced because less coke remains in the drum to be removed.

4.6 Examples

The following examples are included herein for illustrative purposes and are not meant to be limiting.

4.6.1 Example 1

Example 1 is the control/comparative Example and is a non-additized resid which was subjected to coking. The results as illustrated below show that the non-additized resid of Example 1 results in sponge coke formation upon coking, whereas the same resid with the additives of the invention results in shot coke formation.

Examples 2, 3 and 4 use the same resid feed as the control Example 1—namely, a sweet vacuum tower bottoms (VTB), which is a sponge coke-forming resid. In Example 2, 3,000 wppm (weight parts per million) of pyrene was added. In Example 3, 3,000 ppm of a heavy aromatic fuel oil (HAFO) was added. In Example 43,000 wppm of sulfonated lignin was added.

The addition of additives into the vacuum resid feeds in Examples 2, 3 and 4 was performed in the following manner. First, the resid feed was heated to about 70-150° C. to decrease its viscosity. Then the additive was added slowly, with mixing, for a time sufficient to disperse and/or solubilize the additive.

For laboratory experiments, it is generally preferred to first dissolve and/or disperse the additive in a solvent (e.g., toluene, or water) and blend it with stirring into the heated resid, or into resid to which some solvent has been added to reduce its viscosity. Alternatively, the additive can be dissolved in a solvent and a solvent can be added to the resid to decrease its viscosity. Blending of the dissolved additive and lower viscosity resid solution can take place even at room temperature. The solvent(s) can then be removed. In a refinery, the additive or additive dissolved in resid contacts the resid when it is added to, or combined with, the resid feed. As discussed, the contacting of the additive and the feed can be accomplished by blending a feed fraction containing additive species (including feed fractions that contain such species) into the feed. Additives are generally soluble in the resids. To assure maximum dispersion of the additive into the resid feed, the reaction mixture may be heat soaked.

4.6.3 Microcarbon Residue (MCR) Tests

The standard Micro Concarbon Residue (MCR) test shows the effectiveness of the additives in examples 1 and 2 in enhancing or facilitating the formation of shot coke in delayed coking compared to the comparative example. MCR tests were run for examples 2, 3 and 4 and the comparative/control example 1. The MCR tests were performed according to the following procedure. A sample of vacuum residuum (2 g) is heated from room temperature to 100° C. over 10 minutes under a nitrogen flow of 66 cc/min. The temperature is then increased from 100-300° C. at the 66 mL/min flow rate and from 300-500° C. at a reduced nitrogen flow rate of 19.5 cc/min over 30 min. The sample is then held at 500° C. for 15 min at 19.5 mL/min flow rate of nitrogen and finally cooled to room temperature over 40 minutes while maintaining the 19.5 mL/min nitrogen flow rate. The coke produced from the resid is weighed and expressed as a weight percent based on the weight of the starting sample. The MCR cokes of Examples 1 (control), 2, 3 and 4 are given in FIGS. 1, 2, 3 and 4 respectively.

4.6.5 Polarized Light Optical Microscopy

Polarized Light Optical Microscopy is the preferred method for identifying and characterizing the morphology of thermal coke. The key indicator is the optical texture of the polished cross-section of the sample. In most cases, thermal coke consists of small regions of anisotropic (ordered) carbon called mosaics (ranging in size from less than a micron to 10 microns) and larger regions called domains (greater than 10 microns). The larger the mosaic or domain size, the greater the degree of order in the coke. The observed anisotropic structure in thermal coke is made possible by a liquid crystal precursor called mesophase, which begins to form from the liquid phase above 400° C. The greater the opportunity for the mesophase to grow and coalesce in the liquid phase, the greater the degree of order in the thermal coke. Factors affecting mesophase growth include the properties of the pitch, the coking temperature and the time spent at temperature. Therefore, the observed anisotropic texture of a thermal coke reveals qualitative information on the conditions in which the coke was formed. Isotropic coke, in contrast, is usually formed by decomposition of polymeric material or other highly cross-linked structure that has not gone through the intermediate fluid phase.

Optical microscope samples were prepared using techniques known in the art. Examples 1, 2, 3 and 4 were prepared by embedding the coke sample in epoxy, followed by a series of standard grinding and polishing procedures. The highly polished cross-section of each sample is then examined under reflected cross-polarized light. In order to add color to the image, a λ retardation plate (full wave) is inserted between the cross polars. The resulting pink, blue and yellow regions of the sample (mosaics and domains) are caused by different orientations of the anisotropic material with respect to the polarized light. Observations of examples 1 and 2 and the comparative example were made with a 20× or 50× oil immersion objective in order to enhance contrast. Observations made on the samples include general morphology, particle size, degree of anisotropy, reflectance, porosity and inclusions (such as metal sulfides).

FIG. 1 is an optical micrograph of the comparative example. The micrograph of FIG. 1 shows coke formed from the sponge coke-forming resid feed is a sweet vacuum tower bottoms (VTB) with no additive. The viewing area shown is 174 microns by 130 microns. The micrograph shows a mosaic structure and fine anisotropic particles that are aggregated into string like aggregate structures (typical of sponge coke). The micrographs flow domains ranging in size from about 10 to about 30 micrometers (typical of sponge coke) and minor regions of coarse mosaic ranging from about 5 to about 10 micrometers (typical of shot coke).

Figure 2:
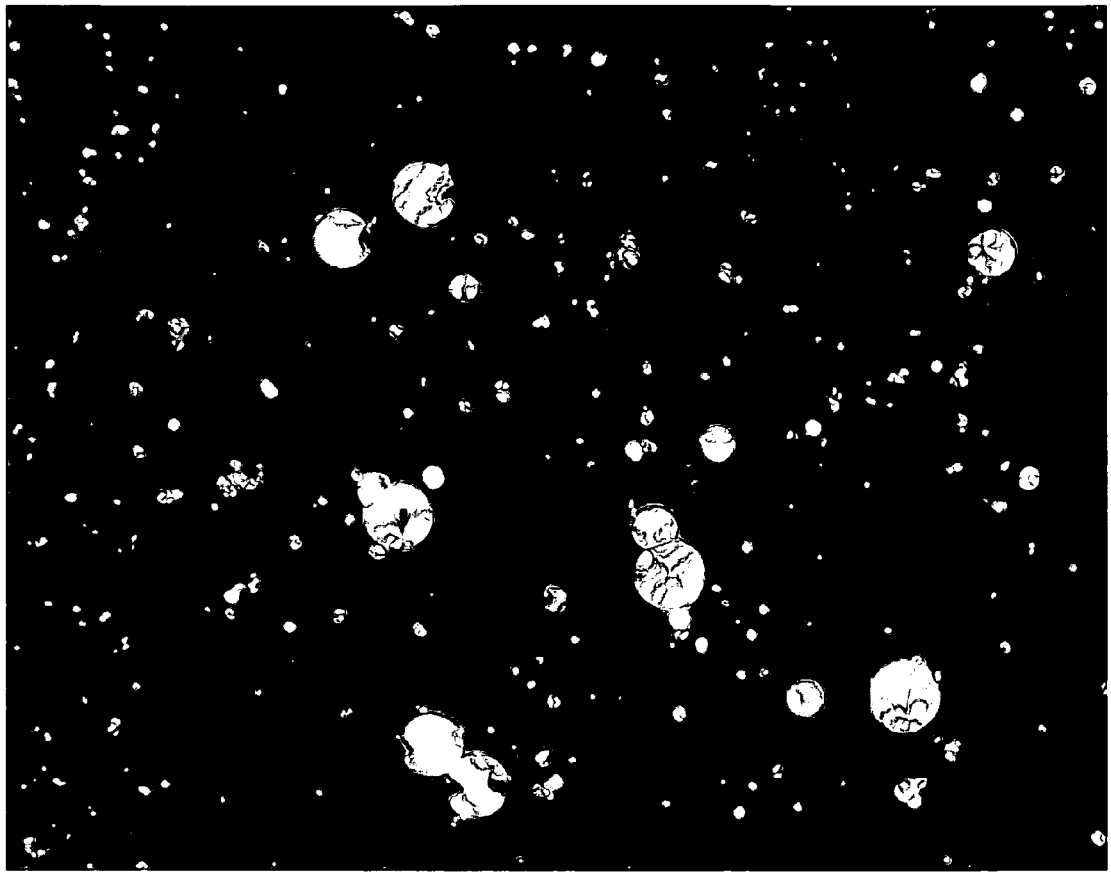
FIG. 2 is an optical micrograph, with a viewing area of 174 microns by 130 microns, showing an inventive example of coke formed from the sponge coke-forming resid feed of FIG. 1 to which 3,000 wppm of pyrene was added.

FIG. 2 shows the effect on coke morphology of adding 3,000 wppm of pyrene to the sponge coke-forming resid prior to coking. FIG. 2 is an optical micrograph showing coke formed from the same resid feed of FIG. 1 to which 3,000 wppm of pyrene was added. Again, the viewing area shown is 174 microns by 130 microns. FIG. 2 shows mesophase Spheres (2-10 mm) with sub-micron spheres in isotropic matrix. The mesospheres are not aggregated and also the sub micron size spheres dominate. This micrograph is typical of a shot coke formation additive.

Figure 3:
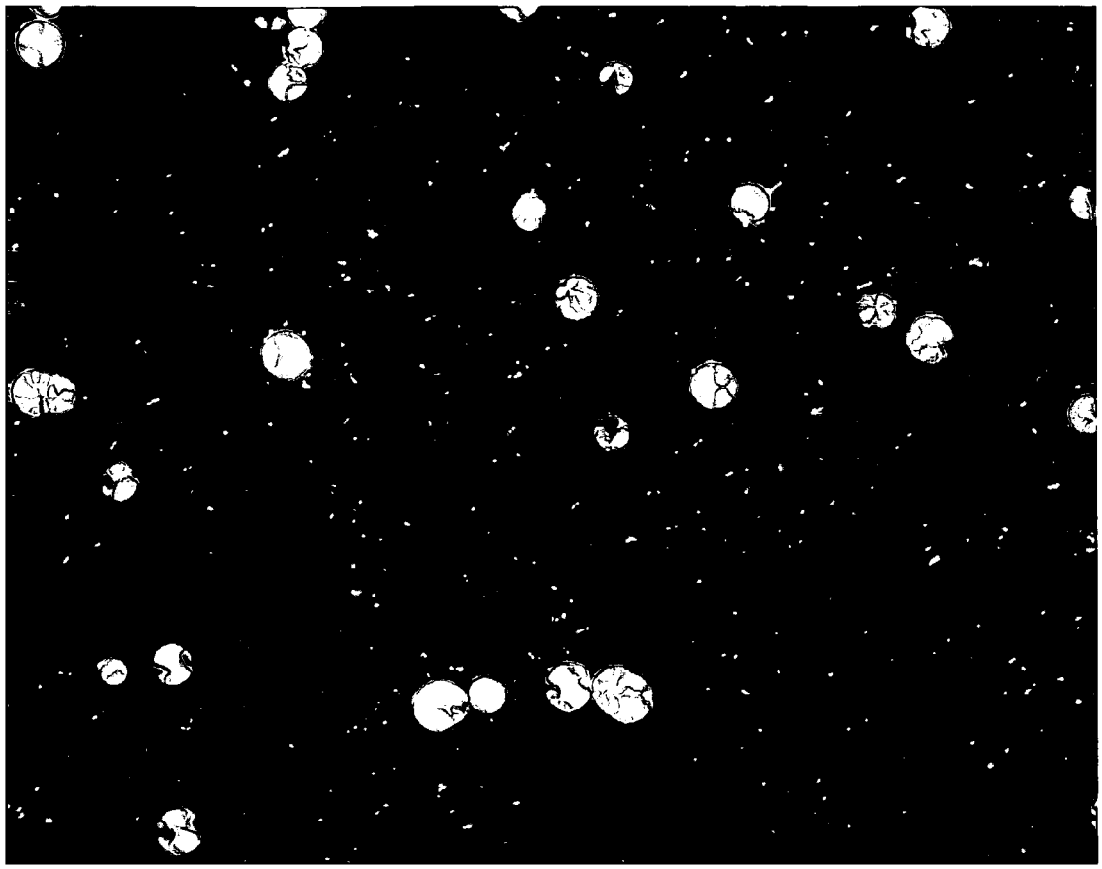
FIG. 3 is an optical micrograph, with a viewing area of 174 microns by 130 microns, showing an inventive example of coke formed from the sponge coke-forming resid feed of FIG. 1 to which 3,000 ppm of Heavy Aromatic Fuel Oil (which is a mixture of polynuclear aromatic compounds) was added.

FIG. 3 shows the effect on coke morphology of adding 3,000 wppm of Heavy Aromatic Fuel Oil (which is a mixture of unsubstituted and methyl substituted PNAs) to the resid prior to coking. FIG. 3 is an optical micrograph showing coke formed from the sponge coke forming resid feed of FIG. 1 to which 3,000 wppm of Heavy Aromatic Fuel Oil was added. Again, the viewing area shown is 174 microns by 130 microns. FIG. 3 also shows mesophase Spheres (2-10 mm) with sub-micron spheres in isotropic matrix. The mesospheres are not aggregated and also the sub micron size spheres dominate. This is micrograph is also typical of a shot coke formation additive.

A comparison of the micrographs of both FIG. 2 and FIG. 3 to FIG. 1 illustrates the significant effect of the additives on coke morphology. The addition of the additives drives the coke morphology to the formation of shot coke.

Figure 4:
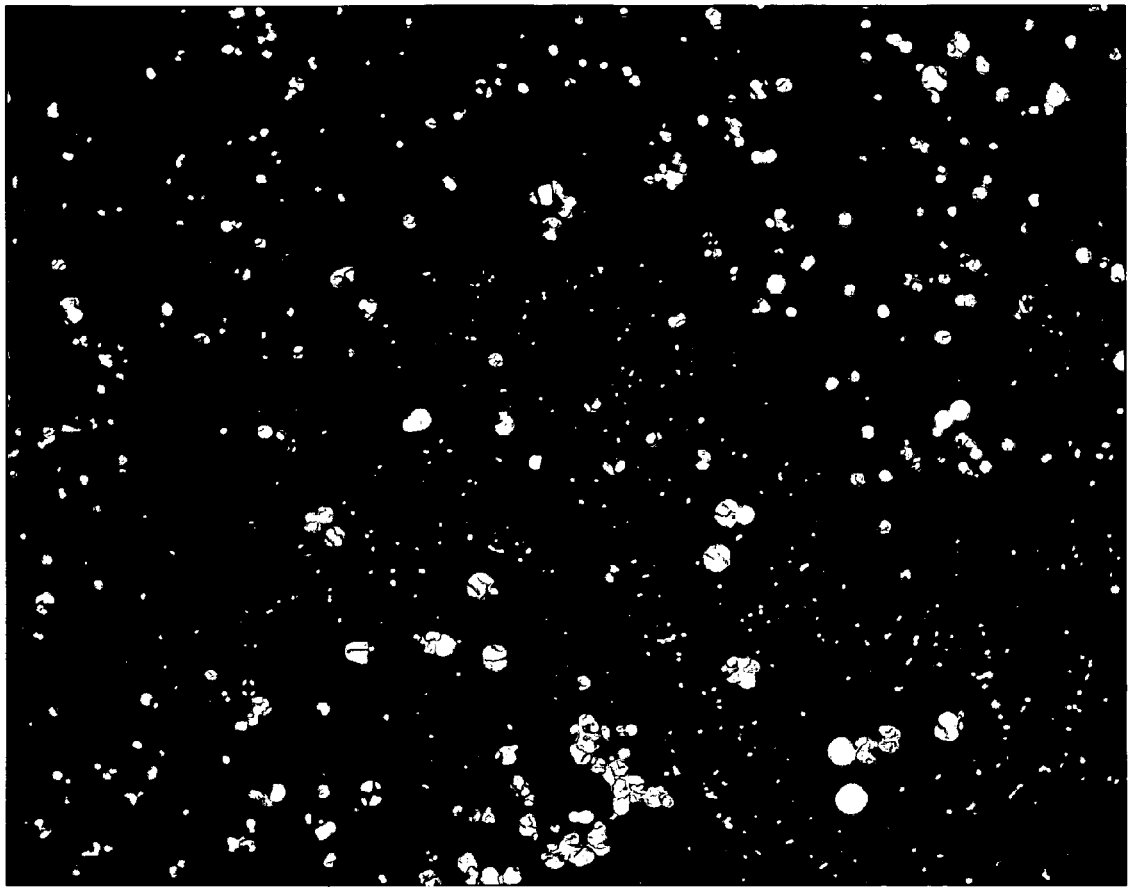
FIG. 4 is an optical micrograph with a viewing area of 174 microns by 130 microns, showing an inventive example of coke formed from the sponge coke-forming resid feed of FIG. 1 to which 3,000 wppm of sulfonated lignin was added.

FIG. 4 represents a run with sodium lignin sulfonic acid. We observe mesophase Spheres (2-10 mm) with sub-micron spheres in an isotropic matrix. The mesospheres are NOT aggregated and also the sub micron size spheres dominate. This is typical of a shot coke formation additive.

4.7 Alternatives

There will be various modifications, adjustments, and applications of the disclosed invention that will be apparent to those of skill in the art, and the present application is intended to cover such embodiments. Accordingly, while the present invention has been described in the context of certain preferred embodiments, it is intended that the full scope of the invention be measured by reference to the scope of the following claims.

What is claimed is:

1. A method of altering the coke morphology in a delayed coking process of heavy oil comprising:

a) contacting a salt of a lignin sulfonate with a carrier solvent to form a mixture;

b) contacting the heavy oil with the mixture to form an additized heavy oil, whereby the amount of the salt of a lignin sulfonate is in an amount of 10 to 50,000 wppm, based on the amount of the heavy oil and effective to increase the formation of substantially free-flowing coke during coking operations; and c) thermally treating said additized heavy oil at a coking temperature in a coking zone.

2. The method of claim 1 wherein the heavy oil is a vacuum resid.

3. The method of claim 1 where the additized heavy oil is thermally treated at a temperature range of 380° C. to 480° C. in a coking zone.

4. The method of claim 1 which further comprises the step of first providing the additive with a carrier solvent and then contacting the heavy oil with a mixture of additive and carrier solvent.

5. The method of claim 1 wherein the effective amount of additive is from 10 to 50,000 wppm based on the weight of the heavy oil.

6. The method of claim 1 wherein the effective amount of additive is from 50 to 600 wppm.

7. The method of claim 1 where the additive is contacted with the heavy oil after the rapid heating of the heavy oil in a furnace.

8. The method of claim 1 where the additive is contacted with the heavy oil during the transfer of the heavy oil from the furnace to the coking zone.

9. The method of claim 1 where the coking zone is a drum.

10. The method of claim 9 comprising the additional step of discharging free-flowing coke from the drum without cutting.

11. The method of claim 10 where a majority of the coke in the drum is free-flowing and discharged without cutting.

12. The method of claim 1 in which the salt of a lignin sulfonate is a metal of Group 1 or 2 of the Periodic Table.

13. The method of claim 1 in which the salt of a lignin sulfonate is a sodium, potassium, or calcium salt of a sulfonated lignin.

14. The method of claim 1 in which the carrier comprises an aromatic hydrocarbon solvent.

15. The method of claim 1 in which the carrier comprises water, alcohol or mixtures of water and alcohol.

16. The method of claim 1 in which the amount of the lignin sulfonate salt is from 20 to 1000 ppmw based on the amount of the heavy oil.

17. The method of claim 1 in which the amount of the lignin sulfonate salt is from 50 to 600 ppmw based on the amount of the heavy oil.

* * * * *